US006460358B1

(12) United States Patent
Hebert

(10) Patent No.: US 6,460,358 B1
(45) Date of Patent: Oct. 8, 2002

(54) FLASH GAS AND SUPERHEAT ELIMINATOR FOR EVAPORATORS AND METHOD THEREFOR

(76) Inventor: Thomas H. Hebert, 1340 Eastwood Dr., Lutz, FL (US) 33612

( * ) Notice: Subject to any disclaimer, the term of this patent is extended or adjusted under 35 U.S.C. 154(b) by 0 days.

(21) Appl. No.: 09/711,583

(22) Filed: Nov. 13, 2000

(51) Int. Cl.[7] ..... F25B 41/04
(52) U.S. Cl. ..... 62/225; 62/513
(58) Field of Search ..... 62/225, 513, 324.1; 236/92 B

(56) References Cited

U.S. PATENT DOCUMENTS 3,423,954 A * 1/1969 Harnish et al ..... 62/513
5,524,455 A * 6/1996 Hasegawa et al. ..... 62/513
5,547,126 A * 8/1996 Bogrand, IV et al. ..... 62/225
5,678,419 A * 10/1997 Sanada et al. ..... 62/513

FOREIGN PATENT DOCUMENTS

JP 54-121448 * 9/1979 ..... 62/513

* cited by examiner

*Primary Examiner*—William E. Tapolcai
(74) *Attorney, Agent, or Firm*—Holland & Knight LLP

(57) ABSTRACT

A low pressure suction side refrigerant to liquid refrigerant heat exchanger, located in the refrigeration circuit in such a way that the sensor (and external equalizer tube, if applicable) is located downstream of the low pressure refrigerant outlet of the heat exchanger, provides for effectively eliminating both the superheat and flash gas loss regions of the evaporator which in turn increases the mass flow through the evaporator and increases the refrigerating capacity of the evaporator at very little increase in compressor power thereby providing for increased system efficiency for refrigerating or cooling purposes. On the heating side, heat rejection capacity of a heat pump is increased even more dramatically because of the heat reclaim of the flash gas loss heat, which provides for even greater efficiency increases for heating applications.

4 Claims, 8 Drawing Sheets

BristolCompressors Performance Table: H26A56QDBL 60 Hz

Refrigerant: R-22 Dist. Cement: 5.463 in.3
Motor: 2-Pole Voltage: 230-3-60
Subcooling: 15.0 °F SuperHeat: 20.0 °F

*FIG. 6*

| CONDENSER TEMPERATURE (°F) | | Evaporator Temperature (°F) -20 | -15 | -10 | -5 | 0 | 5 | 10 | 15 | 20 | 25 | 30 | 35 | 40 | 45 | 50 | 55 |
|---|---|---|---|---|---|---|---|---|---|---|---|---|---|---|---|---|---|
| 80 | Capacity(Btu/Hr) | 10788 | 13711 | 17143 | 21043 | 25373 | 30093 | 35162 | 40542 | 46192 | 5207.2 | 58144 | 64366 | 70700 | 77106 | 83544 | 89974 |
| | Power (Watts) | 1766 | 1952 | 2138 | 2322 | 2497 | 2659 | 2803 | 2923 | 3015 | 3075 | 3096 | 3074 | 3004 | 2822 | 2701 | 2458 |
| | Current (Amps) | 5.2 | 5.7 | 6.3 | 6.8 | 7.4 | 7.9 | 8.3 | 8.7 | 9.0 | 9.2 | 9.3 | 9.2 | 9.0 | 8.7 | 8.1 | 7.4 |
| | MassFlow (Lbs/Hr) | 140.2 | 177.6 | 221.1 | 270.2 | 324.4 | 382.9 | 445.2 | 510.6 | 578.7 | 6487 | 720.2 | 792.4 | 864.7 | 936.7 | 1007.6 | 1076.9 |
| | SER (Btu/(W Hr)) | 6.11 | 7.03 | 8.02 | 9.06 | 10.16 | 11.32 | 12.55 | 13.87 | 15.32 | 16.94 | 18.78 | 20.94 | 23.53 | 26.76 | 30.93 | 36.60 |
| 90 | Capacity(Btu/Hr) | 9308 | 11873 | 14980 | 18590 | 22662 | 27157 | 32035 | 37256 | 42782 | 48571 | 54584 | 60782 | 67125 | 73573 | 80086 | 86625 |
| | Power (Watts) | 1744 | 1939 | 2140 | 2344 | 2545 | 2738 | 2918 | 3080 | 3220 | 3332 | 3412 | 3454 | 3454 | 3406 | 3306 | 3149 |
| | Current (Amps) | 5.1 | 5.7 | 6.3 | 6.9 | 7.5 | 8.0 | 8.6 | 9.1 | 9.5 | 9.9 | 10.1 | 10.2 | 10.2 | 10.1 | 9.8 | 9.3 |
| | MassFlow (Lbs/Hr) | 126.1 | 159.6 | 200.0 | 246.5 | 298.5 | 355.6 | 417.0 | 482.1 | 550.5 | 621.3 | 694.2 | 768.4 | 843.3 | 918.4 | 993.1 | 106.57 |
| | SER (Btu/(W Hr)) | 5.34 | 6.12 | 7.0 | 7.93 | 8.91 | 9.92 | 10.98 | 12.10 | 13.29 | 14.58 | 16.00 | 17.60 | 19.44 | 21.60 | 24.22 | 27.51 |
| 100 | Capacity(Btu/Hr) | 8093 | 10250 | 12902 | 16250 | 20014 | 24234 | 28871 | 33884 | 39235 | 44882 | 50788 | 56911 | 63121 | 69652 | 76190 | 82788 |
| | Power (Watts) | 1717 | 1917 | 2129 | 2349 | 2572 | 2792 | 3005 | 3205 | 3389 | 3550 | 3685 | 3787 | 3852 | 3876 | 3852 | 3777 |
| | Current (Amps) | 5.1 | 5.6 | 6.2 | 6.9 | 7.5 | 8.2 | 8.8 | 9.4 | 9.9 | 10.4 | 10.8 | 11.1 | 11.3 | 11.4 | 11.3 | 11.1 |
| | MassFlow (Lbs/Hr) | 115.1 | 144.5 | 181.3 | 224.8 | 274.5 | 329.7 | 389.9 | 454.4 | 522.6 | 594.0 | 667.9 | 743.8 | 821.0 | 898.9 | 976.9 | 1054.5 |
| | SER (Btu/(W Hr)) | 4.71 | 5.35 | 6.10 | 6.92 | 7.78 | 8.68 | 9.61 | 10.57 | 11.58 | 12.64 | 13.78 | 15.03 | 16.41 | 17.97 | 19.78 | 21.92 |
| 110 | Capacity(Btu/Hr) | 7181 | 8879 | 11187 | 14063 | 17469 | 21364 | 25709 | 30464 | 35589 | 41046 | 46793 | 52791 | 59001 | 65382 | 71896 | 78501 |
| | Power (Watts) | 1680 | 1882 | 2101 | 2334 | 2575 | 2819 | 3061 | 3296 | 3519 | 3726 | 3912 | 4071 | 4198 | 4289 | 4338 | 4341 |
| | Current (Amps) | 5.1 | 5.6 | 6.2 | 6.9 | 7.5 | 8.3 | 9.0 | 9.7 | 10.3 | 10.9 | 11.5 | 12.0 | 12.3 | 12.6 | 12.7 | 12.7 |
| | MassFlow (Lbs/Hr) | 106.2 | 131.2 | 164.0 | 204.2 | 251.2 | 304.2 | 362.8 | 426.3 | 494.1 | 565.6 | 640.3 | 717.5 | 796.5 | 876.9 | 958.0 | 1039.2 |
| | SER (Btu/(W Hr)) | 4.27 | 4.72 | 5.32 | 6.03 | 6.78 | 7.58 | 8.40 | 9.24 | 10.11 | 11.01 | 11.96 | 12.97 | 14.06 | 15.25 | 16.57 | 18.08 |

FIG. 6 continued

BristolCompressors Performance Table: H26A56QDBL 60 Hz

| | | | |
|---|---|---|---|
| Refrigerant: | R-22 | Dist. Cement: | 5.463 in.3 |
| Motor: | 2-Pole | Voltage: | 230-3-60 |
| Subcooling: | 15.0 F | SuperHeat: | 20.0 F |

| CONDENSER TEMPERATURE (°F) | | Evaporator Temperature (°F) -20 | -15 | -10 | -5 | 0 | 5 | 10 | 15 | 20 | 25 | 30 | 35 | 40 | 45 | 50 | 55 |
|---|---|---|---|---|---|---|---|---|---|---|---|---|---|---|---|---|---|
| 120 | Capacity(Btu/Hr) | | 7800 | 9632 | 12067 | 15064 | 18584 | 25587 | 27034 | 31884 | 37099 | 42637 | 48461 | 54529 | 60802 | 67240 | 73804 |
| | Power (Watts) | | 1832 | 2056 | 2297 | 2552 | 2816 | 3083 | 3349 | 3609 | 3858 | 4091 | 4302 | 4488 | 4642 | 4761 | 4389 |
| | Current (Amps) | | 5.6 | 6.1 | 6.8 | 7.5 | 8.3 | 9.0 | 9.8 | 10.6 | 11.3 | 12.0 | 12.6 | 13.2 | 13.6 | 14.0 | 14.2 |
| | MassFlow (Lbs/Hr) | | 118.4 | 147.1 | 183.6 | 227.4 | 278.0 | 334.6 | 396.8 | 463.8 | 535.1 | 610.2 | 688.3 | 769.0 | 851.5 | 935.3 | 1019.8 |
| | SER (Btu/(W Hr)) | | 4.26 | 4.69 | 5.25 | 5.9 | 6.60 | 7.33 | 8.07 | 8.83 | 9.62 | 10.42 | 11.26 | 12.15 | 13.10 | 14.12 | 15.25 |
| 130 | Capacity(Btu/Hr) | | | | 10300 | 12839 | 15933 | 19545 | 23633 | 28158 | 33081 | 38361 | 43959 | 49835 | 55949 | 62263 | 68735 |
| | Power (Watts) | | | | 2235 | 2501 | 2781 | 3070 | 3363 | 3656 | 3943 | 4219 | 4479 | 4719 | 4934 | 5118 | 5267 |
| | Current (Amps) | | | | 6.7 | 7.4 | 8.2 | 9.0 | 9.9 | 10.7 | 11.6 | 12.4 | 13.2 | 13.9 | 14.5 | 15.0 | 15.5 |
| | MassFlow (Lbs/Hr) | | | | 161.8 | 202.2 | 249.9 | 304.2 | 364.7 | 430.6 | 501.4 | 576.5 | 655.3 | 737.1 | 821.4 | 907.6 | 995.0 |
| | SER (Btu/(W Hr)) | | | | 4.61 | 5.13 | 5.73 | 6.37 | 7.03 | 7.70 | 8.39 | 9.09 | 9.81 | 10.56 | 11.34 | 12.17 | 13.05 |
| 140 | Capacity(Btu/Hr) | | | | | | 13451 | 16620 | 20299 | 24449 | 29030 | 34001 | 39324 | 44958 | 50864 | 57002 | 63332 |
| | Power (Watts) | | | | | | 2712 | 3019 | 3335 | 3657 | 3978 | 4294 | 4600 | 4891 | 5162 | 5407 | 5623 |
| | Current (Amps) | | | | | | 8.0 | 8.9 | 9.8 | 10.7 | 11.7 | 12.6 | 13.5 | 14.4 | 15.2 | 15.9 | 16.5 |
| | MassFlow (Lbs/Hr) | | | | | | 218.8 | 270.5 | 329.0 | 393.4 | 463.4 | 538.1 | 617.2 | 699.9 | 785.6 | 873.8 | 963.8 |
| | SER (Btu/(W Hr)) | | | | | | 4.96 | 5.51 | 6.09 | 6.69 | 7.30 | 7.92 | 8.55 | 9.19 | 9.85 | 10.54 | 11.26 |
| 150 | Capacity(Btu/Hr) | | | | | | | | 17072 | 20796 | 24985 | 29597 | 34594 | 39936 | 45583 | 51496 | 57634 |
| | Power (Watts) | | | | | | | | 3263 | 3610 | 3961 | 4314 | 4661 | 4999 | 5322 | 5626 | 5906 |
| | Current (Amps) | | | | | | | | 9.6 | 10.6 | 11.6 | 12.6 | 13.7 | 14.7 | 15.6 | 16.5 | 17.3 |
| | MassFlow (Lbs/Hr) | | | | | | | | 288.5 | 351.1 | 419.8 | 494.0 | 573.0 | 656.2 | 743.0 | 832.8 | 925.1 |
| | SER (Btu/(W Hr)) | | | | | | | | 5.23 | 5.76 | 6.31 | 6.86 | 7.42 | 7.99 | 8.56 | 9.15 | 9.76 |

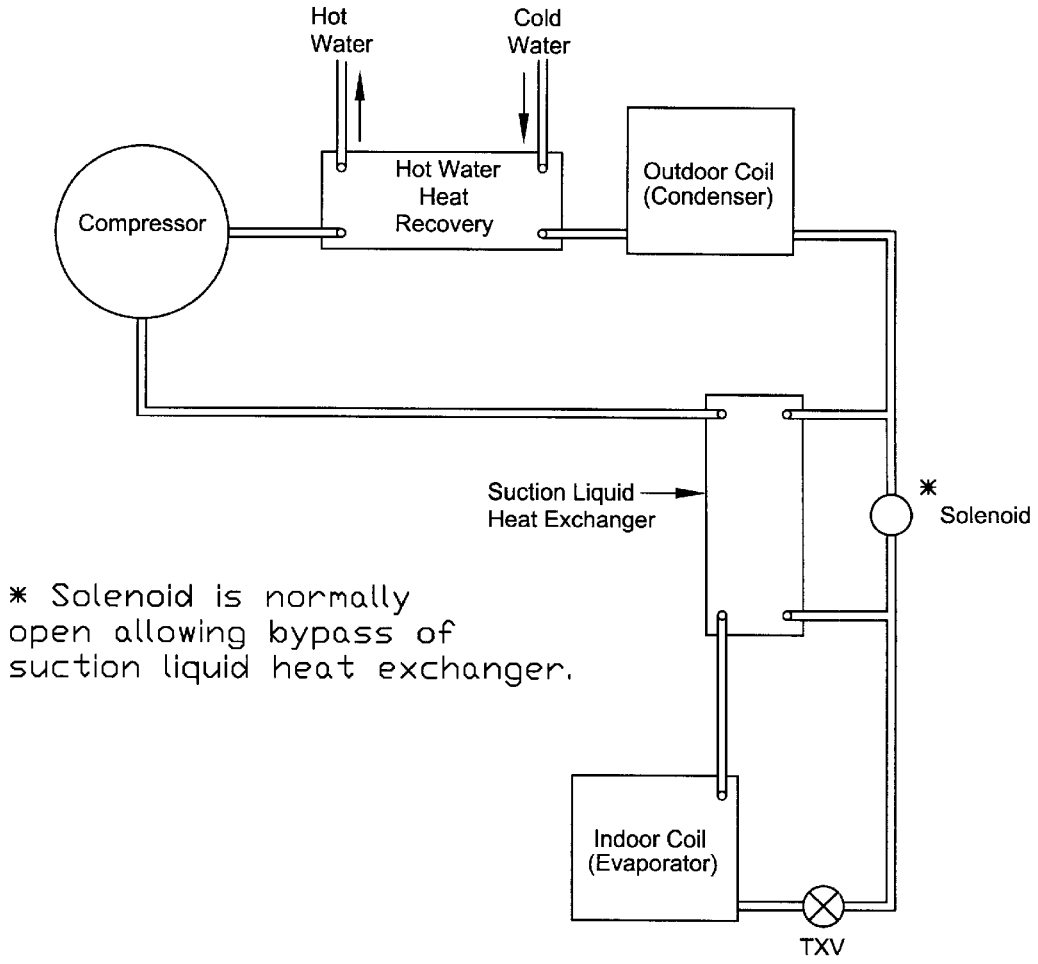

* Solenoid is normally open allowing bypass of suction liquid heat exchanger.

ODT and/or Hot Gas Temperature Sensor and/or Hot Water Sensor Settings provide set points to close solenoid causing liquid refrigerant to pass thru Heat Exchanger to provide;

1. Higher Hot Gas Discharge Temperature for exhausted Hot Water Heat Recovery.
2. Lower Liquid Temperature for increased capacity and efficiency.

*FIG. 8*

FLASH GAS AND SUPERHEAT ELIMINATOR FOR EVAPORATORS AND METHOD THEREFOR

BACKGROUND OF THE INVENTION

1. Field of the Invention

The present invention relates to a refrigerant suction side to liquid refrigerant heat exchanger located in such a way that the sensing bulb of a thermostatic expansion valve (TXV) whether mechanical or electronic, is located downstream of the heat exchanger, which is in turn downstream of the evaporator, in the direction of flow of the suction gas towards the compressor, so that the preset superheat setting of the thermostatic expansion device/valve is not exceeded by the action of the heat exchanger.

This invention more particularly pertains to the heat exchanger reducing or eliminating both the flash gas loss and superheat regions of an evaporator, thereby increasing the effective surface area of an evaporator and providing for a colder average temperature of the evaporator and providing for an increased mass flow of refrigerant through the evaporator and thereby an increased heat absorbing capacity of the evaporator.

Where the primary function of the refrigerant is to provide heat such as in a heat pump, pool heater or dedicated heat pump water heater, the overall coefficient of performance of the heat pump is dramatically increased in the evaporator efficiency improvement as well as by the heat reclaiming action of the heat exchanger of the heat contained in the liquid refrigerant.

2. Description of the Background Art

Presently there exist many types of devices designed to operate in the thermal transfer cycle. The vapor-compression refrigeration cycle is the pattern cycle for the great majority of commercially available refrigeration systems. This thermal transfer cycle is customarily accomplished by a compressor, condenser, throttling device and evaporator connected in serial fluid communication with one another. The system is charged with refrigerant, which circulates through each of the components. More particularly, the refrigerant of the system circulates through each of the components to remove heat from the evaporator and transfer heat to the condenser. The compressor compresses the refrigerant from a low-pressure superheated vapor state to a high-pressure superheated vapor state thereby increasing the temperature, enthalpy and pressure of the refrigerant. A superheated vapor is a vapor that has been heated above its boiling point temperature. It then leaves the compressor and enters the condenser as a vapor at some elevated pressure where the refrigerant is condensed as a result of the heat transfer to cooling water and/or to ambient air. The refrigerant then flows through the condenser condensing the refrigerant at a substantially constant pressure to a saturated-liquid state. The refrigerant then leaves the condenser as a high pressure liquid. The pressure of the liquid is decreased as it flows through the expansion valve causing the refrigerant to change to a mixed liquid-vapor state. The remaining liquid, now at low pressure, is vaporized in the evaporator as a result of heat transfer from the refrigerated space. This vapor then enters the compressor to complete the cycle.

The ideal cycle and hardware schematic for vapor compression refrigeration is shown in FIG. 1 as cycle 1-2-3-4-1. More particularly, the process representation in FIG. 1 is represented by a pressure-enthalpy diagram, which illustrates the particular thermodynamic characteristics of a typical refrigerant. The P-h plane is particularly useful in showing the amounts of energy transfer as heat. Referring to FIG. 1, saturated vapor at low pressure enters the compressor and undergoes a reversible adiabatic compression, 1-2. Adiabatic refers to any change in which there is no gain or loss of heat. Heat is then rejected at constant pressure in process 2-3, an adiabatic pressure change occurs through the expansion device in process 3-4, and the working fluid is then evaporated at constant pressure, process 4-1, to complete the cycle.

However, the actual refrigeration cycle may deviate from the ideal cycle primarily because of pressure drops associated with the fluid flow and heat transfer to or from the surroundings.

It is readily apparent that the evaporator plays an important role in removing heat from the thermal cycle. Evaporators convert a liquid to a vapor by the addition of heat extracted from the air or other material in contact with the evaporator. The evaporator surface area has three distinct zones; the flash gas loss area, where the liquid refrigerant is cooling adiabatically (no heat transfer theoretically) to the phase change temperature; the phase change area where the liquid refrigerant is evaporating because of heat being absorbed from the material the evaporator is in contact with and; the superheat region where all of the liquid has been evaporated and now the gas phase refrigerant is absorbing heat.

Both the flash gas loss region and the superheat region of the evaporator are less effective at removing heat than the phase change area. By reducing or eliminating both of these areas and increasing the area of phase change, the entire surface area of the evaporator becomes more effective in removing heat. In fact, the colder the refrigeration application the greater the effect of this elimination of the flash gas loss and superheat regions. The low pressure, suction side to liquid refrigerant heat exchanger, with the sensing bulb or sensor of a mechanical or electronic thermostatic expansion valve located downstream of the heat exchanger in the direction towards the compressor, accomplishes maximum subcooling by allowing sufficient excess refrigerant through the TXV to fully subcool the liquid refrigerant while maintaining the superheat setting of the TXV, thereby reducing or eliminating both the flash gas loss region and superheat regions of the evaporator.

There currently are known low pressure, suction side to liquid refrigerant heat exchangers where superheat above the TXV superheat set point is utilized to subcool the liquid refrigerant. The problem with these known heat exchangers are that this increased superheat temperature reduces the volumetric efficiency of the compressor, increases the hot gas discharge temperature, increases the operating temperature of the compressor thereby decreasing the operational life expectancy of the compressor and only minimally affects the liquid refrigerant temperature because of the limited effectiveness of using superheat only to cool the liquid refrigerant.

None of the known embodiments of the suction side to liquid refrigerant heat exchanger art deals with these known deficiencies that exist within the scope of this type of heat exchanger art.

In response to these realized inadequacies of earlier configurations of low pressure, suction side to liquid refrigerant heat exchangers used within the thermal transfer cycle of air conditioners, refrigeration equipment and heat pumps, it became clear that there is a need for a suction side to liquid refrigerant heat exchanger that would overcome these realized inadequacies. The result of the use of this new low pressure, suction side to liquid refrigerant heat exchanger system design being greater refrigeration capacity and improved dehumidification (for air cooling systems), both gained at relatively little additional power consumption for the total refrigeration thermal cycle. The greater capacity being realized from the higher mass flow of refrigerant through the evaporator due to improved evaporator heat exchange brought about by the reduction or elimination of the flash gas loss and superheat regions in the evaporator through the use of the new and improved low pressure, suction side to liquid refrigerant heat exchanger system. Further, in heating applications, in addition to the improved heat absorption effect on the evaporator, the low pressure, suction side to liquid refrigerant heat exchanger acts as a reclaimer for heat normally wasted in the flash gas region thereby providing even more heating capacity. Inasmuch as the art comprises various types of evaporator low pressure, suction side to liquid refrigerant heat exchangers, and condenser thermal transfer cycle configurations, it can be appreciated that there is a continuing need for and interest in improvements to evaporator low pressure, suction side to liquid refrigerant heat exchanger and condenser systems and their configurations, and in this respect, the present invention addresses these needs and interests.

Therefore, an object of this invention is to provide an improvement, which overcomes the aforementioned inadequacies of the prior art devices and systems and provides an improvement, which is a significant contribution to the advancement of the evaporator, suction side to liquid refrigerant heat exchanger and condenser system art.

Another objective of the present invention is to provide a new and improved low pressure, suction side to liquid refrigerant heat exchanger system, which has all of the advantages and none of the disadvantages of, the earlier low pressure, suction side to liquid refrigerant heat exchanger systems as utilized in a thermal transfer cycle.

Still another objective of the present invention is improved thermodynamic efficiency.

Yet another objective of the present invention is to provide maximum subcooling of the liquid refrigerant before entering the evaporator, through a thermostatic expansion valve, thereby reducing or eliminating the flash gas loss region of the evaporator.

An additional objective of the present invention is to provide maximum liquid refrigerant subcooling without exceeding the superheat setting of the thermostatic expansion valve.

Yet a further objective of the present invention is to minimize adverse affects to the compressor due to the low pressure, suction side to liquid refrigerant heat exchanger and evaporator system.

An additional objective of the present invention is to provide increased refrigeration capacity.

Still another objective of the present invention is to provide an apparatus and method that will increase overall refrigerant mass flow thereby increasing refrigeration capacity while doing so in a more efficient manner.

Another objective of the present invention is to allow for increased latent heat removal in air-cooling systems and therefore provide increased dehumidification.

And yet a further objective of the present invention is to reclaim normally wasted heat that occurs when warm liquid refrigerant cools down to the phase change temperature in the flash gas loss region of an evaporator thereby increasing the efficiency and heating capacity of a heat pump.

And still another objective of the present invention is to provide an evaporator low pressure, suction side to liquid refrigerant heat exchanger, and condenser system that is highly reliable in use.

Even yet another objective of the present invention is to provide an evaporator, low pressure, suction side to liquid refrigerant heat exchanger, and condenser system having an increased Energy Efficiency Ratio (EER) as a result of increased refrigeration capacity at a relatively small increase in wattage input.

Yet another objective of the present invention is to overcome evaporator design deficiencies whereby the warmer superheat region and flash gas loss region are located downstream in the air flow direction from the colder phase change region of the evaporator by reducing or eliminating these warmer regions.

And still another objective of the present invention is to provide an apparatus and method that will increase the heating capacity of heat pump systems by increasing the effectiveness of the evaporator while reclaiming the heat normally lost by the liquid refrigerant in the flash gas loss region of the outdoor coil of a heat pump operating in the heat pump mode.

The foregoing has outlined some of the more pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure.

Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to an apparatus and system that satisfies the need for increased refrigeration capacity in any kind of refrigeration system and increased dehumidification in air cooling systems as well as increased capacity and efficiency of any type of heat producing heat pump refrigeration system.

For the purpose of summarizing the invention, the low pressure, suction side refrigerant to liquid refrigerant heat exchanger system, for reducing or eliminating flash gas loss and superheat regions of an evaporator and reclaiming liquid refrigerant flash gas loss heat, comprises a low pressure side to liquid refrigerant heat exchanger with the low pressure gas side of the heat exchanger located downstream of the refrigeration systems evaporator, yet upstream of the sensing bulb or sensor of the refrigeration systems thermostatic expansion valve and the liquid side of the heat exchanger located upstream of the thermostatic expansion valve.

Simply, the liquid refrigerant passing through the liquid side of the heat exchanger is cooled by the evaporating and superheating refrigerant passing through the low-pressure side of the heat exchanger. The present invention providing maximum subcooling to the liquid refrigerant yet not exceeding the superheat setting of the TXV.

Moreover, the present invention provides such a cold liquid refrigerant to the TXV that flash gas loss in the evaporator is minimized or eliminated thereby increasing the effective evaporator surface area. Also, the superheat region of the evaporator is eliminated by the present invention so that the effective evaporator surface area is increased even more. Because of the increased effective surface area of the evaporator, a significant increase in refrigerant mass flow through the evaporator is accomplished thereby increasing the refrigeration capacity of the system.

Further, where heating is the primary function of the refrigeration system, such as in a heat pump heating cycle, the heating capacity is increased both by the improved heat absorption capacity of the evaporator as well as by the heat reclaim of liquid refrigerant heat in the low pressure, suction side to liquid refrigerant heat exchanger.

An important feature of the present invention is that the increased mass flow of refrigerant through the evaporator also increases the volumetric efficiency of the compressor, thereby increasing the overall system efficiency.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which:

FIG. 6 is a copy of a typical compressor performance table with the data points located to illustrate the increase in mass flow due to the increased evaporator temperature;

FIGS. 8 and 8*a* are hardware schematics of the vapor compression cycle for a straight cool application of the superheat enhancement.

DETAILED DESCRIPTION OF THE PREFERRED EMBODIMENT

With reference to the drawings, and in particular to FIGS. 2, 3, 4, and 5 thereof, a new and improved low pressure, suction side to liquid refrigerant heat exchanger system embodying the principles and concepts of the present invention and generally designated by the reference number (10) will be described. The low pressure, suction side to liquid refrigerant heat exchanger (10) comprises a refrigerant to refrigerant heat exchanger that can be any one of a number of types of heat exchangers including; flat plate; tube in tube; tube on tube; shell and tube or any other suitable type of heat exchanger.

Figure 2:
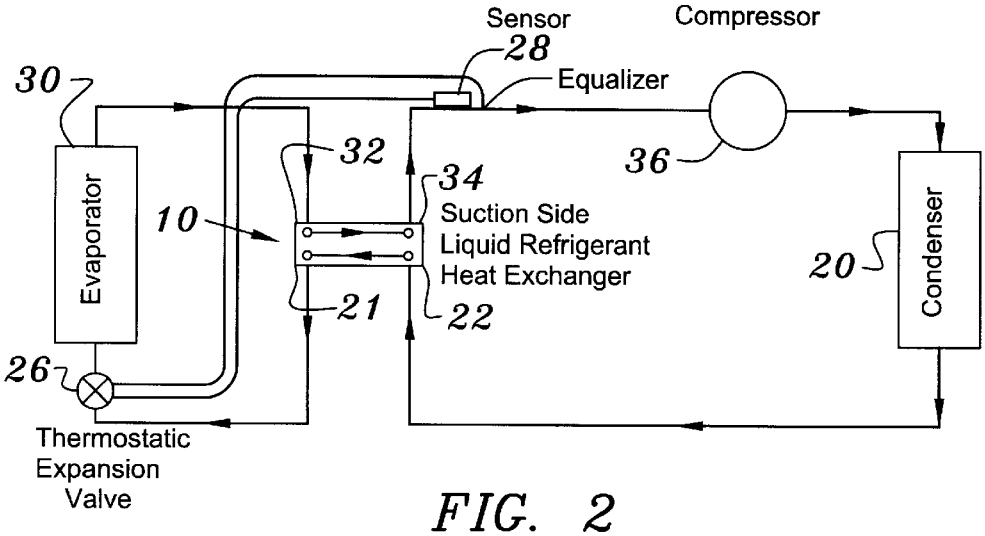
FIG. 2 is a hardware schematic of the vapor compression cycle for an air conditioner or refrigeration system showing the location of the low pressure, suction side to liquid refrigerant heat exchanger and the location of the thermostatic expansion valve sensor.

For air conditioning and refrigeration applications the heat exchanger is connected in serial communication in the refrigeration circuit as illustrated in FIG. 2. Where the liquid refrigerant coming from the condenser (20) is in serial communication with one end (22) of the liquid side of the heat exchanger (10) and the other end (24) of that same side of the heat exchanger (10) is in serial communication with the inlet to the thermostatic expansion valve (26). The suction side refrigerant coming from the evaporator (30) is in serial communication with one end (32) of the suction side of the heat exchanger (10) and the other end (34) of that same side of the heat exchanger is in serial communication with the suction inlet to the compressor (36). The sensor (28) and, if applicable, the external equalizer (29) are located downstream in the direction of flow of the suction side refrigerant, just after the heat exchanger.

Figure 3:
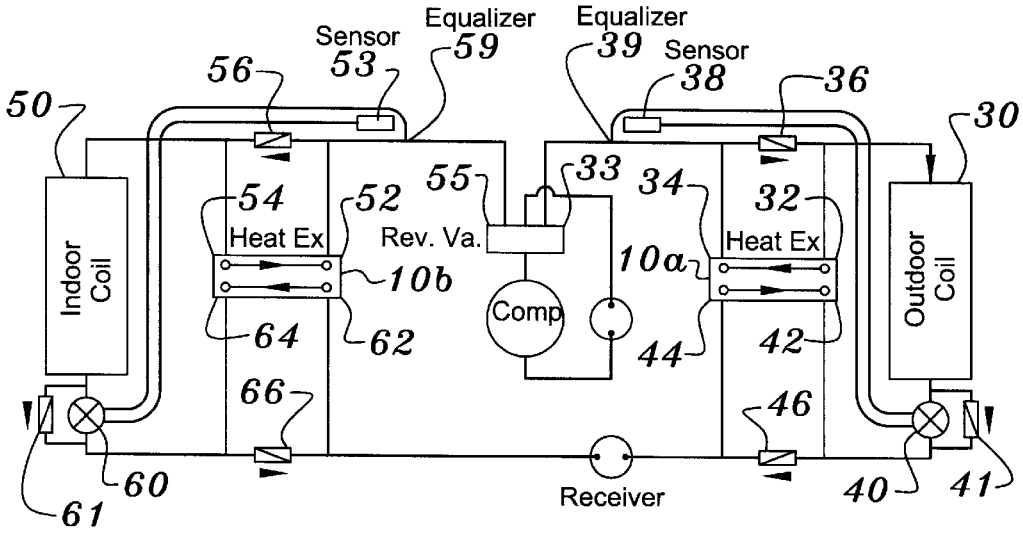
FIG. 3 is a hardware schematic of the vapor compression cycle for a split system heat pump showing the two possible locations of the low pressure, suction side to liquid refrigerant heat exchanger and the relative locations of the thermostatic expansion valve sensors.

For split heat pump applications two heat exchangers are connected in serial communication in the refrigeration unit as illustrated in FIG. 3, where the liquid refrigerant line connected to the outdoor coil (40) is in serial communication with one end (42) of the liquid side of the first heat exchanger (10*a*) and is in serial communication parallel to the heat exchanger through a check valve (48) that only allows flow of liquid refrigerant out of and away from the outdoor coil to pass through the check valve, so that the heat exchanger is bypassed in the cooling mode.

In the heating mode the liquid refrigerant can only pass through the heat exchanger (10*a*) the liquid refrigerant passing in serial communication from the indoor coil (60) through the check valve (66) that allows liquid to bypass the second heat exchanger (10*b*) into the other end (44) of the liquid side of the first heat exchanger (10*a*) and then pass in serial communication from the first end (42) of the liquid side of the first heat exchanger (10*a*) to the inlet of the thermostatic expansion valve for the outdoor coil (40).

In the cooling mode the liquid refrigerant passes in serial communication between the outlet of the outdoor coil (40) through the check valve (46) parallel to the first heat exchanger (10*a*) and then into one end (62) of the liquid side of the second heat exchanger (10*b*) and the other end (64) of the liquid side of the second heat exchanger (10*b*) is in serial communication with the inlet of the thermostatic expansion valve of the outdoor coil (61).

In the heating mode, the low pressure, suction side refrigerant line exiting the outdoor coil (30) is in serial communication with one end (32) of the suction side of the first heat exchanger (10*a*), the check valve (36) preventing bypass of the heat exchanger (10*a*). The other end (34) of the first heat exchanger (10*a*) being in serial communication with one side (33) of the reversing valve of the heat pump system. The check valve (56) of the gas side of the second heat exchanger allows the hot gas to bypass the second heat exchanger (10*b*) in the heating mode.

In the cooling mode, the suction side refrigerant line exiting the indoor coil (50) is in serial communication with one end (54) of the low pressure, suction side of the second heat exchanger (10*b*), the check valve (56) preventing bypass of the heat exchanger (10*b*). The other end (52) of the low pressure, suction side of the second heat exchanger (10*b*) in serial communication with one side (55) of the reversing valve of the heat pump system. The check valve (36) of the first heat exchanger (10*a*) on the gas side of the first heat exchanger allows the hot gas to bypass the first heat exchanger when in the cooling mode.

The sensor (38), and if applicable the external equalizer tube (39), of the outdoor coil thermostatic expansion valve (41) are located on the line between the first heat exchanger (10*a*) (34) and the reversing valve inlet (33). The sensor (58), and if applicable the external equalizer tube (59) of the indoor coil thermostatic expansion valve (61) are located on the line between the second heat exchanger (10*b*) (52) and the reversing valve inlet (55).

Figure 4:
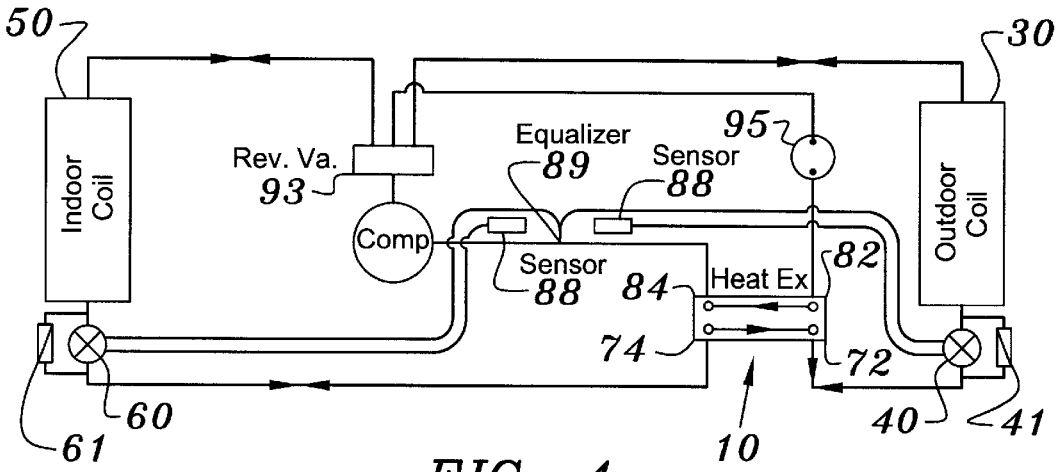
FIG. 4 is a hardware schematic of the vapor compression cycle for a package heat pump system showing the location of the low pressure, suction side to liquid refrigerant heat exchanger and the relative locations of the thermostatic expansion valve sensors.

For package heat pump applications, only one heat exchanger is required, and is connected in serial communication in the refrigeration system as illustrated in FIG. 4 where, the liquid refrigerant line connected to the thermostatic expansion valve and check valve assembly (41) at the outdoor coil (40) is in serial communication with one end (72) of the liquid side of the heat exchanger (10). The other end (74) of the liquid side of the heat exchanger (10) is in serial communication with the thermostatic expansion valve and check valve assembly (61) located at the indoor coil (60). The suction outlet of the reversing valve (93) is in serial communication, either before or after any suction accumulator (95), with the inlet side (82) of the suction (low pressure) side of the heat exchanger (10). The other end (outlet side) (84) of the suction (low pressure) side of the heat exchanger (10*a*) is in serial communication with the low-pressure side (83) of the compressor. Both thermostatic expansion valves (61) (41) sensors (88) and if applicable, external equalizer tubes (89) are located on the suction (low pressure) line connecting the low-pressure outlet (84) to the compressor low-pressure inlet (83).

The advantages of the present invention are as explained below with the following calculations and analysis based on the data and information contained in FIGS. 1, 1*a*, 5 & 6.

Figure 5:
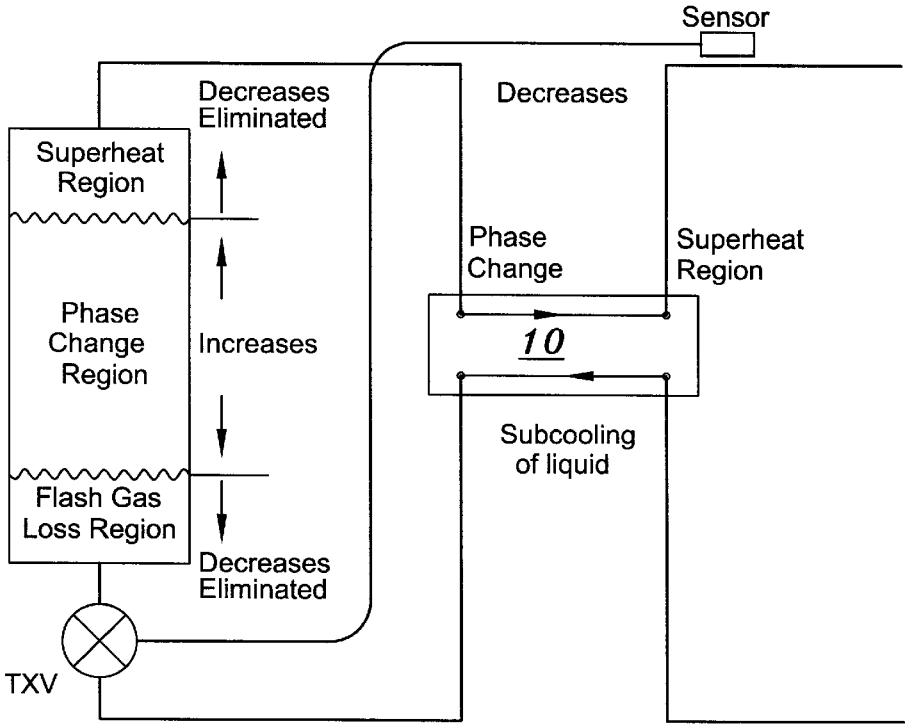
FIG. 5 is a perspective view showing the location of the low pressure, suction side to liquid refrigerant heat exchanger and illustrating the three different regions of the evaporator and the changes in these regions due to the suction side to liquid refrigerant heat exchanger.

As illustrated in FIG. 5, the subcooling of the liquid refrigerant is accomplished by a combination of low side (suction side) phase change and superheating of the suction gas through heat exchange in the heat exchanger (10). There is no net gain of capacity due to a change in enthalpy across the evaporator but rather a gain in capacity due to an increase in effective evaporator surface area, which leads to a higher refrigerant mass flow. By moving the superheat region into the heat exchanger (10) and out of the evaporator, the superheat region of the evaporator is effectively eliminated allowing for an effectively colder average evaporator temperature. Conversely, subcooling the liquid refrigerant significantly closer to the phase change temperature of the evaporator effectively reduces or eliminates the flash gas loss region of the evaporator, which can be quite significant, especially at relatively cold evaporator temperatures. In fact the flash gas loss region size is inversely proportional to the phase change temperature of the evaporator. The colder the evaporator, the larger and more detrimental is the flash gas loss region. Reducing or eliminating this region can significantly improve the evaporator effective surface area, even more so than by eliminating the superheat region. It can be seen that the heat absorbing capacity of a heat pump operating at low evaporator temperatures or for medium to low temperature refrigeration systems, this system would be very effective.

Figure 1:
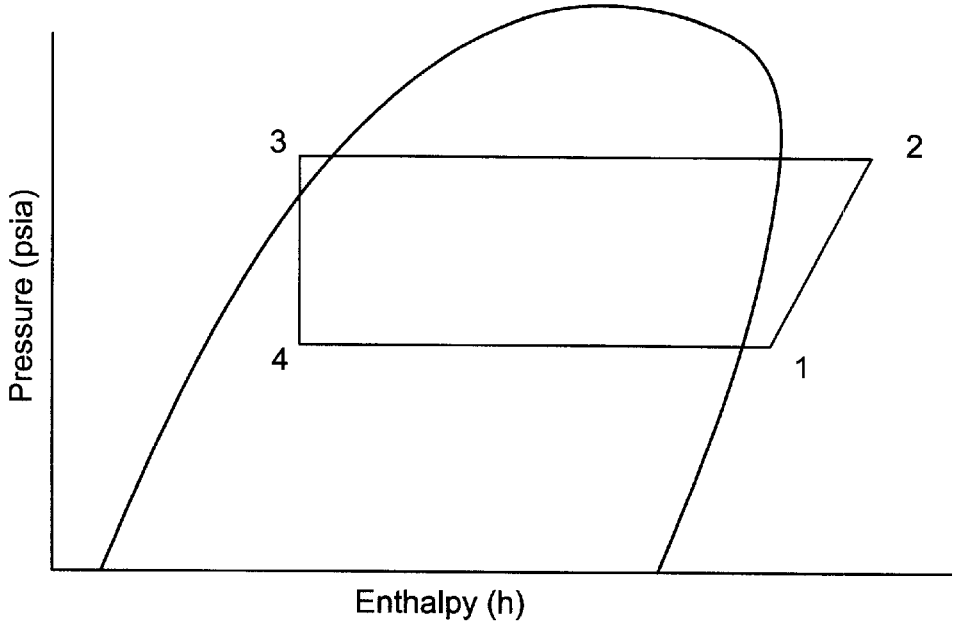
FIG. 1 Prior Art
FIG. 1 is a representation of the refrigeration process on a pressure enthalpy diagram.
Figure 1A:
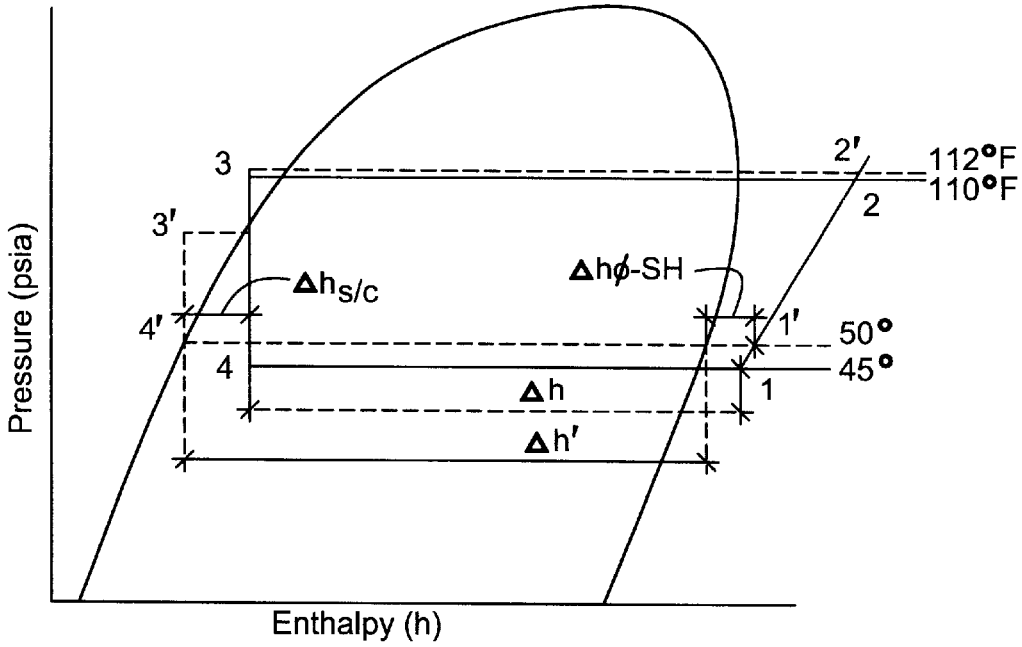
FIG. 1*a* is a pressure enthalpy diagram showing the typical vapor compression cycle with the present invention overlaying a typical compression cycle without the present invention.

It can be seen by looking at the refrigeration cycles superimposed on a P-h diagram in FIG. 1*a*, where the solid lined parallelogram represents the process of the typical cycle without the present invention (FIGS. 1 & 1*a*) and the dashed lined parallelogram represents the process of the cycle with the present invention (FIG. 1*a*). It can be seen that phase change and superheat on the suction side of the heat exchanger of the present invention provides a change in enthalpy of the liquid passing through the liquid refrigerant side of the present invention without increasing the superheat of the refrigerant. ($\Delta h$ phase change & superheat=$\Delta h$ subcooling) A slight net increase in $\Delta h$ across the evaporator ($\Delta h' > \Delta h$) is affected, because of the slant of the saturated vapor line and because of the increased mass flow affected by the increased effective evaporator surface area. It is a known phenomena in the refrigeration art that increasing evaporator surface area will result in an increased mass flow and therefore an increased phase change temperature even though the average coil temperature stays relatively the same. Higher efficiency systems incorporate this principal. Because of the elimination of flash gas loss and superheat regions in the evaporator, this phenomena is even more pronounced. In laboratory experiments with the present invention, for R-22 air conditioning systems, a 5 Degree F. increase in phase change temperature has been observed at 80 Degree F. dry bulb (67 Degree F. wet bulb) entering air temperatures and as much as an 8 Degree F. increase in phase change temperature has been observed at 17 Degree F. dry bulb entering air temperatures. At lower evaporator temperatures this increase in phase change temperatures was even higher. Only a proportionally lower rise in condenser phase change temperature was observed because of the much higher mass flow of the condensing medium compared to the mass flow of the medium being cooled (2.5 to 3.0 times). For a 5 Degree F. increase in evaporator phase change temperature only a 1.5 to 2 Degree F. rise in condenser phase change temperature was observed. From the typical compressor performance table (FIG. 6) it can be seen that the mass flow for an evaporator temperature of 45 Degrees F. and a condenser temperature of 120 Degrees F. would be 851.5 lbs./hr., with a capacity of 60,802 BTUH at a compressor power input of 4,642 watts, which results in a compressor E. E. R. of 13.10. Using the present invention, now the same compressor operates at an evaporator temperature at 50 Degrees F. and a condensing temperature of 122 Degrees F. and would have an extrapolated mass flow of approximately 930 lbs./hr and would have a capacity of 66,859 BTUH (a 10% increase in capacity) at a compressor power input of 4,832 watts for a compressor E. E. R. of 13.84 (5.6% increase in efficiency). For the same compressor and refrigerant, a system without the present invention and operating at an entering air temperature of approximately 30 Degrees F. (medium low refrigeration) would have an initial evaporator temperature of 15 Degrees F. and a condensing temperature of 120 Degrees F., the mass flow would be 396.8 lbs./hr, capacity=27,034 BTUH, power=3, 349 watts, E. E. R.=8.07. Using the present invention and operating at a 21 Degree F. evaporator, 122 Degree F. condenser, a mass flow of 471.4 lbs./hr, a capacity of 32,291 BTUH (a 19.5% increase), compressor power of 3,667 watts and an E. E. R. of 8.81 (9.2% increase in efficiency) would result.

When considering the effect on heat rejection efficiency and capacity gain as in heat pump applications, the effect is even greater since with the present invention, now the added heat absorption in the evaporator has an additional heat gain due to the reclaim of normally lost flash gas loss heat recaptured from the warm liquid.

By way of example: For heat rejection by the condenser, both compressor and evaporator heat for 5 Degrees F. evaporator/90 Degrees F. condenser (heat pump operating at 17 Degrees F. outdoor ambient and 70 Degrees F. entering air temperature) are taken from the same compressor performance table (FIG. 6) the heat rejection would be 27,157 BTUH (From Evaporator) plus 2738×3.1413=9345 BTUH (Compressor Heat)=36,502 BTUH at a compressor power input of 2738 watts for a compressor C. O. P. of 3.9. For the same compressor operating with the present invention, the evaporator temperature would be approximately 11 Degrees F. with a 92 Degree F. condenser and the heat of rejection would be 32,438 BTUH (from evaporator) plus 425 lbs./hr×Δh (subcooling from 80 Degree F. liquid to 20 Degree F. liquid Δh=33.381−16.090)=7349 BTUH, plus 2965×3.413=10,133 BTUH (compressor heat)=49,920 BTUH (a 54% increase in capacity) at a compressor C. O. P. of 4.93 (a 26.5% increase in compressor efficiency in heating).

Straight Cool Application Superheat Enhancement

The following comprises a description of the superheat enhancement for hot water heat recovery for high efficiency HVAC systems, as coupled with the flash gas loss superheat eliminator on a heat pump application or as a stand-alone device for straight cool or refrigerant equipment.

Figure 7:
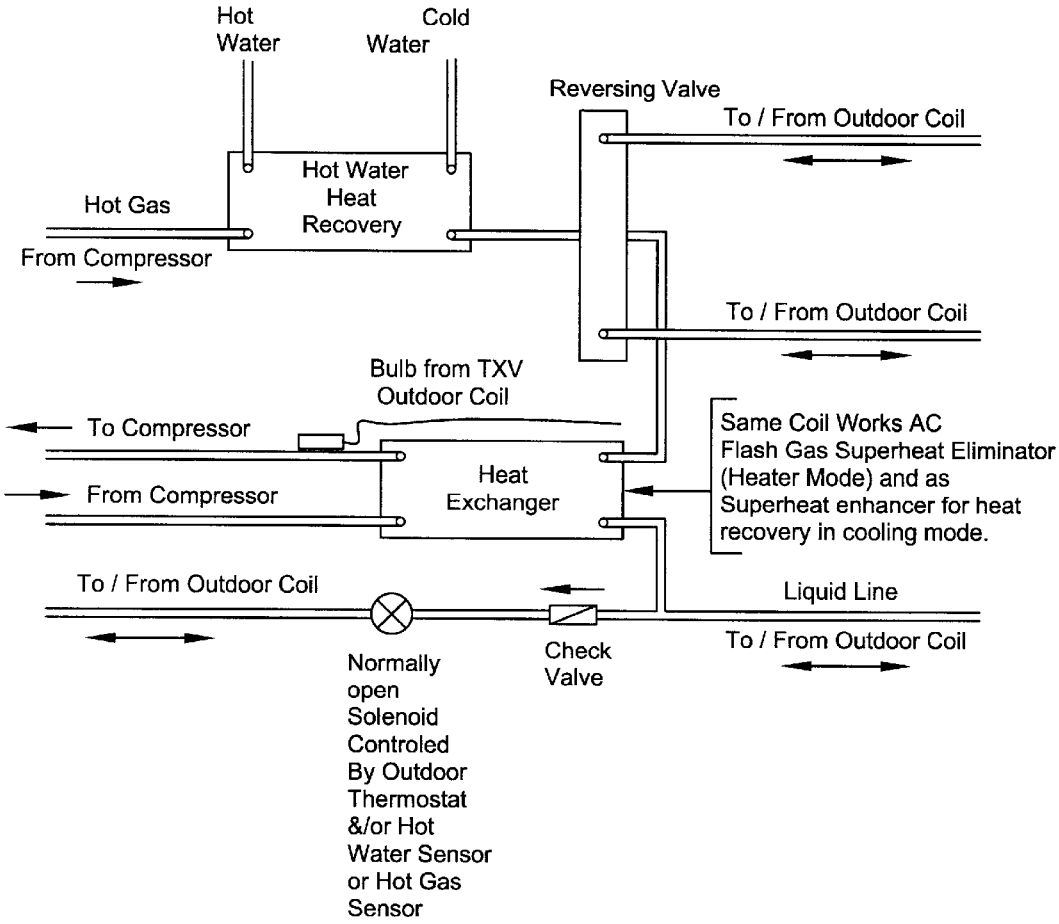
FIG. 7 is a hardware schematic illustrating the super enhancement for hot water hear recovery using a suction to liquid refrigerant heat exchanger.

FIG. 7 illustrates the superheat enhancement for hot water heat recovery using a suction to liquid refrigerant heat exchanger. For a heat pump application, the enhancement of FIG. 7 may be used with or without the flash gas superheat eliminator described above.

In the cooling mode, the liquid refrigerant bypasses the heat exchanger if hot gas temperature exceeds 180 degree F. or if hot water temperature exceeds whatever set point desired and/or if outdoor temperature exceeds whatever is the highest recommended temperature for the best compressor longevity.

If none of the above prevent the solenoid from closing, the solenoid closes forcing the liquid refrigerant to take the path through the heat exchanger providing for additional superheat and a higher hot gas discharge temperature so that hot water heat recovery can occur and also subsequently provides liquid refrigerant subcooling to provide for higher system cooling capacity.

Figure 8A:
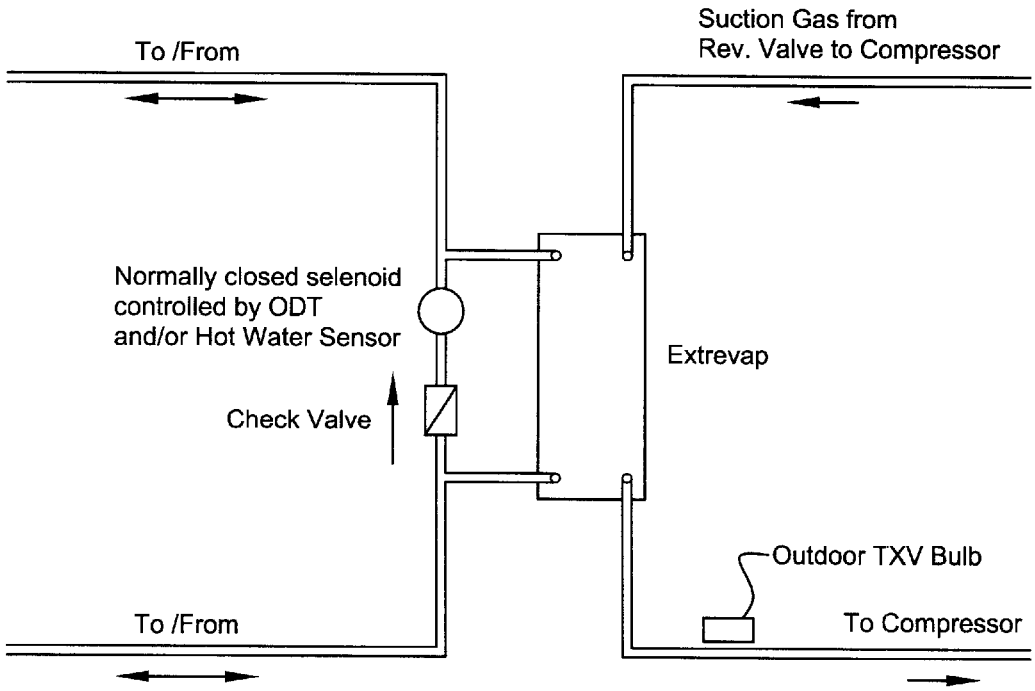

As shown in FIG. 8, the concept is as follows: for high efficiency A/C straight cool or refrigeration systems, the controllable superheat/subcooler is used to provide hot gas refrigerant temperatures required for usable waste heat recovery and could have s secondary use as a flash gas superheat eliminator. As shown in FIG. 8*a*, for high efficiency heat pumps operating in the heating mode, liquid refrigerant passes through the Flash Gas Superheat Eliminator (Extrevap) for space heating enhancement with the TXV bulb of the outdoor coil mounted downstream of the ExtrEvap controlling refrigerant flow through ExtrEvap. In the cooling mode, the solenoid open allowing bypass of the liquid when water, hot gas and/or outdoor temperature settings are reached so minimal heat exchange occurs. When higher hot gas temperatures are required for heat recovery purposes, the solenoid closes forcing the liquid through the heat exchanger resulting in additional superheat and additional subcooling.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described, what is claimed is

What is claimed is:

1. For straight cool and refrigeration systems, a low pressure suction side refrigerant to liquid refrigerant heat exchanger located in a refrigeration circuit, comprising in combination: a low pressure suction side refrigerant portion of the heat exchanger in fluid communication in the refrigeration circuit between an outlet of an evaporator and an inlet of the compressor and a liquid refrigerant portion of the heat exchanger in fluid communication in the refrigeration circuit between an outlet of the condenser and an inlet to a thermostatic expansion device for the evaporator; a sensor and an external equalizer tube being located downstream of the suction, low pressure, side of the heat exchanger on a line connecting the heat exchanger outlet to the compressor inlet; the refrigerant flowing through each portion of the heat exchangers so that a superheat and flash gas loss regions of the evaporator are effectively eliminated, allowing for a greater refrigerant mass flow, and greater refrigeration capacity in the evaporator, as well as allowing for a greater system efficiency.

2. For split system heat pump systems, two low pressure suction side refrigerant to liquid refrigerant heat exchangers and check valve assemblies located in a refrigerant circuit, comprising in combination: a first heat exchanger and check valve assembly where one portion of the first heat exchanger is in fluid communication in the refrigeration circuit between an outlet of an outdoor coil when the outdoor coil is acting as an evaporator, and an inlet to a reversing valve, and with a check valve in a line parallel to that portion of the first heat exchanger directed to prevent bypass when the outdoor coil is acting as an evaporator but allowing bypass when the outdoor coil is acting as a condenser; another portion of the first heat exchanger and check valve assembly being in fluid communication in the refrigeration circuit between an outlet of a liquid side check valve, that allows bypass of a liquid side of the second heat exchanger and an inlet to the thermostatic expansion valve feeding the outdoor coil; a sensor and external equalizer tube of a thermostatic expansion device for the outdoor coil being located immediately downstream of a low pressure suction side outlet of the first heat exchanger assembly, between the heat exchanger and the inlet side of the reversing valve.

3. The split system heat pump system as set forth in claim 2, further comprising in combination: a second heat exchanger and check valve assembly where one portion of the second heat exchanger is in fluid communication in the refrigeration circuit between an outlet of an indoor coil when the indoor coil is acting as an evaporator and the inlet to the reversing valve, a check valve in a line parallel to that portion of the second heat exchanger directed to prevent bypass when the indoor coil is acting as an evaporator but allowing bypass when the indoor coil is acting as a condenser; another portion of the second heat exchanger and check valve assembly being in fluid communication in the refrigeration circuit between an outlet of the liquid side check valve, that allows bypass of the first heat exchanger, and an inlet to the thermostatic expansion device feeding the indoor coil; a sensor and external equalizer tube of a thermostatic expansion device for the indoor coil being located immediately downstream of a low pressure suction side outlet of the second heat exchanger assembly between the heat exchanger and an inlet side of the reversing valve; the refrigerant flowing through the first heat exchanger when the system is in the heating mode so that the superheat and flash gas loss regions of the outdoor coil evaporator are effectively eliminated, allowing for a greater refrigerant mass flow and greater refrigeration capacity in the evaporator as well as allowing for greater heat rejection in the indoor coil condenser due to both the increased evaporator capacity as well as due to the reclaim of heat from the liquid refrigerant, resulting in greater system efficiency; and conversely the refrigerant flowing through the second heat exchanger when the system is in the cooling mode so that the superheat and flash gas loss regions of the indoor coil evaporator are effectively eliminated, allowing for a greater capacity in the evaporator as well as allowing for a greater system efficiency.

4. For package heat pump systems, one low pressure suction side refrigerant to liquid refrigerant heat exchanger is located in a refrigerant circuit comprising in combination:

a low pressure suction side refrigerant portion of the heat exchanger in fluid communication in the refrigeration circuit between an outlet of a reversing valve and an inlet to the low pressure side of a compressor; and a liquid refrigerant portion of the heat exchanger being in fluid communication in the refrigeration circuit between a thermostatic expansion device and check valve assembly for an outdoor coil and thermostatic expansion device and check valve assembly for an indoor coil; sensors and external equalizer tubes of both thermostatic expansion devices being located downstream of the low pressure suction side of the heat exchanger on a line connecting the heat exchanger outlet to a low pressure inlet of the compressor; the refrigerant flowing through each portion of the heat exchanger so that superheat and flash gas loss regions are eliminated in the outdoor coil when acting as an evaporator, and are eliminated in the indoor coil when acting as an evaporator, allowing for a greater refrigerant mass flow and greater refrigeration capacity in the evaporator, allowing for heat reclaim of the liquid refrigerant heat for heating capacity additional increase, and allowing for greater system efficiencies in both the heating and cooling modes of a package heat pump.

* * * * *